United States Patent [19]

Scholl

[11] Patent Number: 4,938,157

[45] Date of Patent: Jul. 3, 1990

[54] COMPUTERIZED NUMERICAL CONTROL AUTOMATIC SEWING DEVICE

[75] Inventor: Hans Scholl, Oerlinghausen-Lipperreihe, Fed. Rep. of Germany

[73] Assignee: Kochs Adler Aktiengesellschaft, Fed. Rep. of Germany

[21] Appl. No.: 292,526

[22] Filed: Dec. 30, 1988

[30] Foreign Application Priority Data

Jan. 14, 1988 [DE] Fed. Rep. of Germany ... 8800328[U]

[51] Int. Cl.[5] ..... D05B 21/00; D05B 65/06

[52] U.S. Cl. ..... 112/121.12; 112/287; 112/288

[58] Field of Search ..... 112/121.12, 288, 287, 112/290, 289, 291, 292, 300

[56] References Cited

U.S. PATENT DOCUMENTS

| | | | |
|---|---|---|---|
| 2,707,927 | 5/1955 | Artzt | 112/291 |
| 3,008,437 | 11/1961 | Herr | 112/288 |
| 3,159,124 | 12/1964 | Rubin | 112/290 |
| 3,217,680 | 11/1965 | Harris, Jr. et al. | 112/287 |
| 3,815,533 | 6/1974 | Bray | 112/288 X |
| 4,658,752 | 4/1987 | Keilmann | 112/262.1 |
| 4,674,425 | 6/1987 | Hampel | 112/288 |

*Primary Examiner*—Peter Nerbun

*Attorney, Agent, or Firm*—Laff, Whitesel, Conte & Saret

[57] ABSTRACT

A CNC (Computerized Numerical Control) automatic sewing device comprises a sewing head and a workpiece holder movable in two co-ordinate directions perpendicular to one another for holding a workpiece to be sewn. A thread trimming device is provided adjacent to the stitch forming place and stationary relative to the latter and directly below the workpiece holder.

5 Claims, 3 Drawing Sheets

COMPUTERIZED NUMERICAL CONTROL AUTOMATIC SEWING DEVICE

FIELD OF THE INVENTION

The invention relates to a CNC (Computerized Numeric Control) automatic sewing device comprising a sewing head having a stitch forming place with a thread cut-off device and a workpiece holder for holding a workpiece to be sewn, the sewing head and the workpiece holder being movable relative to one another in two co-ordinate directions by means of two carriages displaceable perpendicularly to one another each along a sliding path to produce a seam within an operating range of the workpiece holder, and a maxium sliding path in both co-ordinate directions being at least the same as the stretch of an operating range in the corresponding co-ordinate direction.

BACKGROUND OF THE INVENTION

When sewing having sewing machines with a thread cut-off device, wherein the needle thread or upper thread, respectively, and the hook thread or lower thread, respectively, are automatically cut off at the end of the sewing action, there is the basic problem that the thread ends hanging down from the workpiece must be severed, i.e. the workpiece must be trimmed. The same applies to the thread ends at the starting point of the seam.

In order to solve this problem it is known from U.S. Pat. No. 2,707,927 for household sewing machines to secure clamping and cutting plates pivotably to the fabric presser foot and to provide a pivotably supported knife below the stitch plate, i.e. directly below the stitch hole. These two knifes are actuated by means of two electro-magnets to be actuated simultaneously. Thus the needle thread is cut off on the upper side of the workpiece and the lower thread is cut off directly below the stitch hole. With this thread cut-off device the cutting off of threads takes place in such a way that only infinitely short thread ends remain which need no more trimming.

From U.S. Pat. No. 4,674,425 a thread trimming head is known with a heating wire to sever a thread chain thermically and with a suction tube to guide the thread chain to the heating wire. The heating wire is arranged laterally outside the suction tube to protect it from extreme cooling through the air current. This thread trimming head is arranged above the stitch forming place and serves in particular to sever the thread chain of double-chain-stitch sewing machines.

U.S. Pat. No. 3,159,124 arranges a suction tube adjacent to the stitch forming place to suck in the thread or the thread chain, respectively. A heating wire in this suction tube melts the sucked-in thread thermically.

It is further known to trim a workpiece, which has been sewn and taken out of the sewing machine, by means of trimming devices of the above-mentioned kind.

SUMMARY OF THE INVENTION

It is the object of the invention to provide a CNC (Computerized Numerical Control) automatic sewing device, in which trimming of the thread ends hanging down from the lower side of a sewn workpiece is incorporated into the sewing cycle.

According to the invention this is achieved by providing a thread trimming device adjacent to the stitch forming place and stationary relative to the latter and directly below the workpiece holder. The maximum sliding path into each co-ordinate direction is in each case at least equal to the stretch of the operating range in the corresponding co-ordinate direction plus the distance of the trimming device from the stitch forming place in the corresponding co-ordinate direction. The features according to the invention make it possible to feed the workpiece held in the workpiece holder to the thread trimming device which is situated directly below the workpiece holder and in which these thread ends are severed, i.e. cut off, almost flush with the workpiece. As a result of the stationary placing of the thread trimming device in relation to the stitch forming place on the one hand, and of the constructive featuring of the sliding paths of the workpiece holder in relation to the sewing head in both co-ordinate directions on the other hand, it is possible to carry out this trimming immediately after sewing and with a final thread cut-off action. The trimming device is particularly simple. In a very advantageous embodiment of the invention the thread trimming device ensures a fusion or welding together, respectively, of the thread ends, so that a seam is achieved which is efficiently locked at its starting and end point.

Numerous further advantages and features of the invention will become apparent from the following description of an embodiment with reference to the drawing.

DETAILED DESCRIPTION OF THE EMBODIMENT

Figure 2:
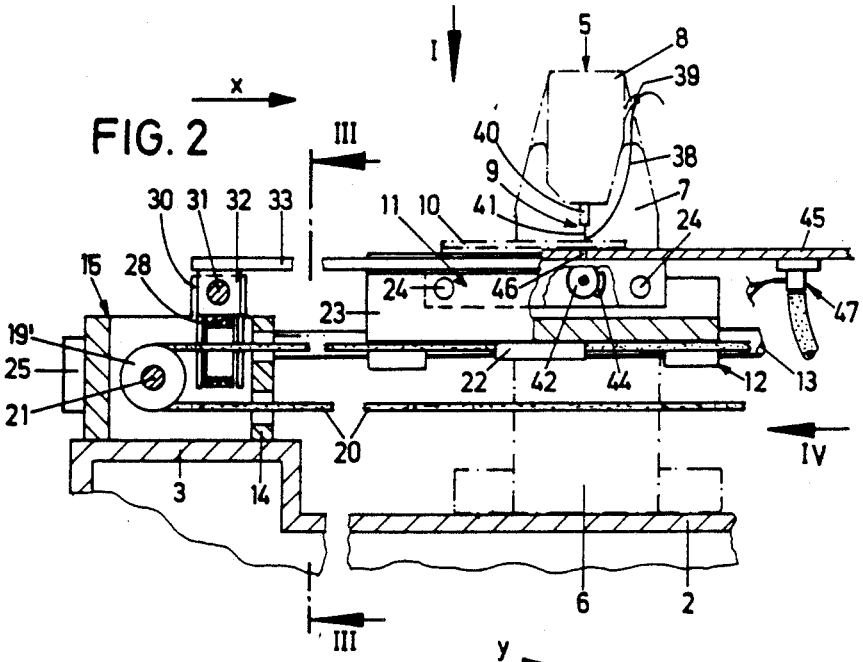
FIG. 2 is a vertical partial section taken along line II—II in FIG. 1.
Figure 3:
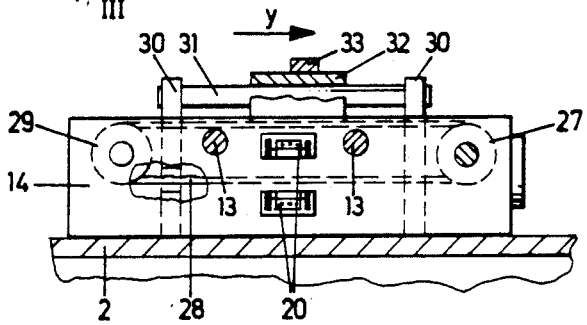
FIG. 3 is a vertical partial cross-section taken along line III—III in FIG. 2.
Figure 4:
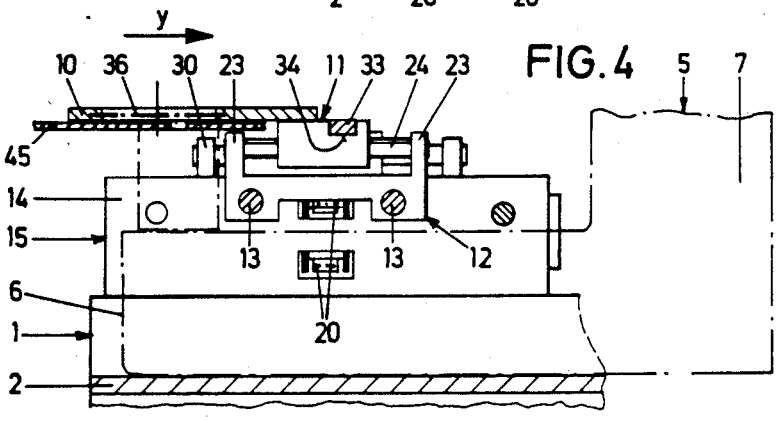
FIG. 4 is a partial side elevation in the direction of arrow IV in FIG. 2.

Referring to the drawingts there is illustrated a CNC automatic sewing device mounted to a stand 1 comprising an intermediate section 2 and two lateral sections 3 and 4. On the intermediate section 2 of the stand 1 there is arranged a sewing head 5, the base plate 6 which is mounted to the intermediate section 2. The sewing head 5 is formed with a standard 7 extending upwardly from the base plate 6, and an upper arm 8 extending from the standard 7 in parallel with respect to the base plate 6. In the area of the free ends of the base plate 6 and the upper arm 8 there are arranged stitch forming instruments 9. Between the base plate 6 and the upper arm 8, i.e. in the area of the stitch forming instruments 9, there is arranged a workpiece holder 10 movable into two directions of co-ordinate, i.e. in y-direction corresponding to the main direction of the sewing head 5, and in x-direction extending perpendicularly thereto as obvious from FIG. 2. The workpiece holder 10 is associated to an x-y-carriage-system. This system provides a y-carriage 11 and an x-carriage 12, wherein the workpiece holder 10 is directly connected to the y-carriage 11. The y-carriage 11 is supported and guided on the x-carriage 12 and displaceable in the y-direction relative to the x-carriage 12. The x-carriage 12 is displaceable in the x-direction relative to the stand 1. Consequently, the y-carriage 11 together with the workpiece holder 10 is displaceable in the x- and y -direction relative to the stand 1.

The x-carriage 12 is displaceably arranged on two guide rods 13, which are stationarily mounted to the stand 1 and which extend parallel to each other. The guide rods 13 are received with each of their ends in bearing webs 14, 14' of bearing blocks 15, 15' mounted to the two lateral sections 3 and 4, respectively, of the stand 1 by means of screws 16.

Figure 1:
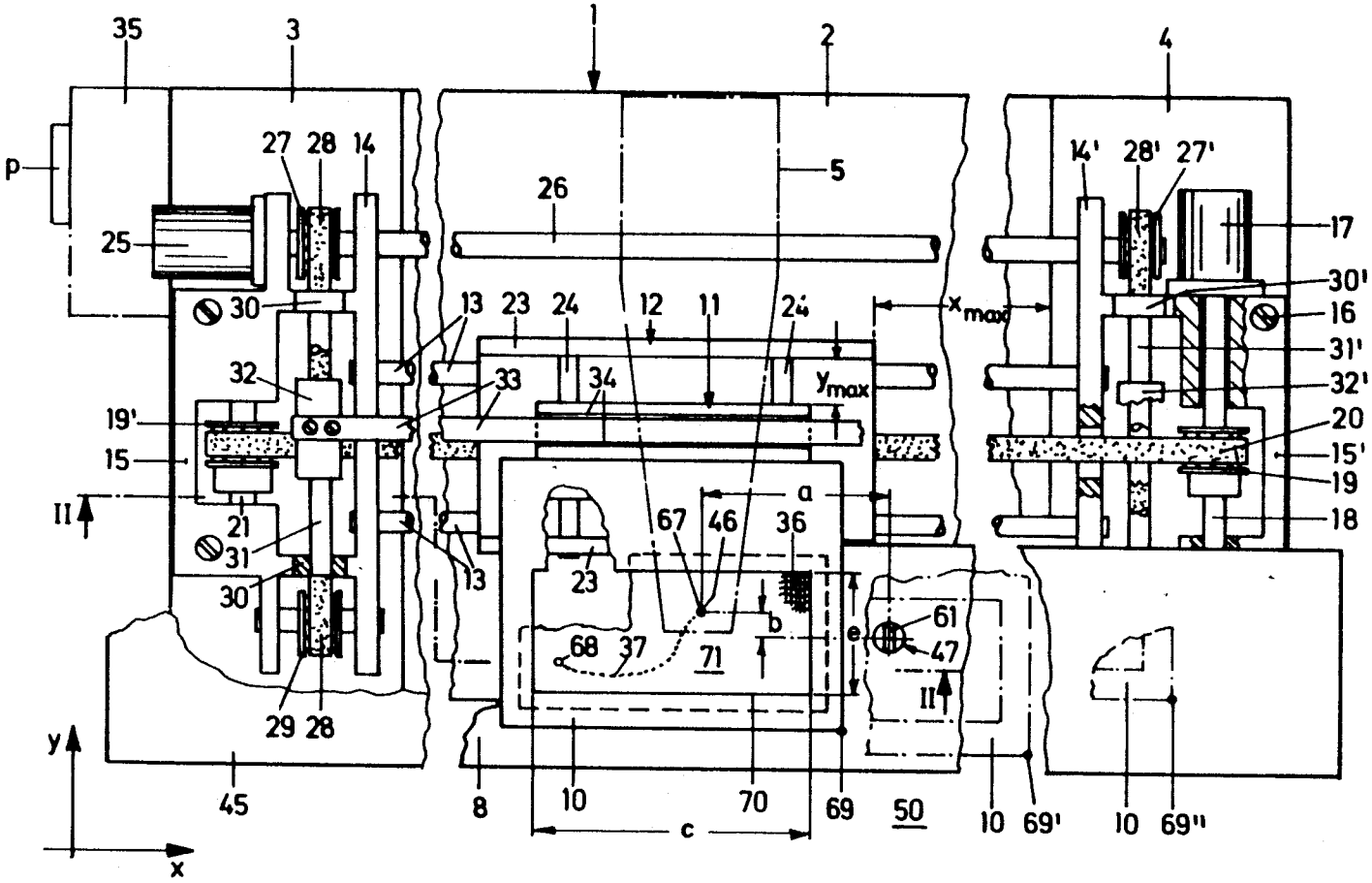
FIG. 1 is a top plan view of an automatic sewing device according to the invention in the direction of arrow I in FIG. 2, a sewing head only being indicated by dot-dash lines.

To one bearing blocks 15', which is shown in FIG. 1 associated to the right lateral section 4, there is mounted a drive motor 17 for the x-carriage 12. This motor 17 drives a timing belt pulley 19 via a shaft 18, which is suported in the bearing block 15'. The timing belt pulley 19 in turn drives an endless timing belt 20 via wa timing belt pulley 19The timing belt pulley 19' is rotatably supported in the bearing block 15'. The timing belt pulley 19 in turn drives an endless timing belt 20 via wa timing belt pulley 19'. The timing belt pulley 19' is rotatably surface of the x-carriage 12 by means of a fastening means 22, so that the x-carriage 12 may be displaced on the guide rods 13 in the x-direction when correspondingly driven by the drive motor 17. The x-carriage 12 is provided with side walls 23, which extend in the x-direction and carry guide rods 24 extending in the y-direction. The y-carriage 11 is supported on the guide rods 24 and displaceable in the y-direction.

The drive of the y-carriage 11 is accomplished by a drive motor 25. The drive motor 25 is mounted to the bearing block 15 and directly drives a shaft 26 supported in the two bearing blocks 15, 15'. The shaft 26 extends in the x-direction. In both bearing blocks 15, 15' timing belt pulleys 27 and 27', respectively, are fixedly mounted to the shaft 26, i.e. the timing belt pulleys 27 and 27', respectively, are rotatingly drivable by the shaft 26. These timing belt pulleys 27 and 27', respectively, each drive an endless timing belt 28 and 28', respectively. Each of the timing belts 28, 28' is guided via timing belt pulleys 29 of which only one is shown in FIG. 1 and which are also supported in the bearing block 15 and 15', respectively. In parallel with and above the timing belts 28, 28' guide rods 31, 31' are mounted in webs 30, 30' of each bearing block 15, 15'. To each of the guide rods 31, 31' there is mounted a slide bearing 32 and 32', respectively, displaceable in the y-direction. The two slide bearings 32, 32' arranged oppositely to one another are connected by a guide bar 33 extending in the x-direction. Each end of the guide bar 33 is screwed to the corresponding slide bearing 32 or 32', respectively. The guide bar 33 engages a guide groove 34, which is located in the upper surface of the y-carriage 11 and which is matched to the outer circumference of the guide bar 33. The guide groove 34 and the guide bar 33 have no clearance in the y-direction, but they are displaceable to each other in their longitudinal directions, i.e. in the x-direction. Due to the drive of the guide bar 33 in the y-direction, i.e. transversally with respect to its longitudinal direction, by means of the timing belts 28, 28' engaging the two ends of the guide bar 33 via the slide bearings 32, 32' a canting-free drive of the y-carriage 11 in the y-direciton is achieved. Movements of the y-carriage 11 together with the x-carriage 12 in the x-direction are possible without problems since the guide bar 33 absolutely extends in parallel with the guide rods 13, while a correct drive and a correct guidance in the y-direction is achieved due to the fact that the guide rods 31, 31' absolutely extend in parallel with the guide rods 24.

The drive motors 17 and 25 may be disigned as step motors or DC-motors with position feed-back, which effect a very precise program-controlled drive of the x-carriage 12, the y-carriage 11 and thus the workpiece holder 10 in the x-y-direction.

For the program-controlled drive there is provided a control unit 35 with a receptacle for a program carrier P, for example an E-PROM-cassette. In the workpiece holder 10 there is clamped a workpiece 36, in which is produced a seam 37 by means of the stitch forming instruments 9. For producing the seam 37, a needle thread 38 is guided from a spool (not shown) via a thread take-up lever 39 to the stitch forming instruments 9. These stitch forming instruments are in usual manner provided with a needle bar 40, which is supported in the upper arm 8 and which has a needle 41, through which the needle thread 38 is guided. A hook 42 is in usual manner drivably supported in the base plate 6, with a spool for the lower thread 43 being arranged within the hook. A thread cutter 44 is also provided in the base plate 6—associated with the hook 42. The drive of the upper stitch forming instruments located in the base plate 6 and comprising among others the hook 42 is assured in usual manner. A bearing plate 45 is mounted on the stand 1 below the upper stitch forming instruments 9 and above the hook 42. The workpiece holder 10 rests upon the bearing plate 45, which thus serves as a bearing surface for the workpiece 36 to be sewn, held in the workiece holder 10. A stitch hole 46 is provided in this bearing plate 45 for the needle 41 to stitch through. Thus the stitch hole 46 simultaneously localizes the stitch forming place.

A thread trimming device 47 is arranged on the bearing plate 45, serving to sever the thread ends 48, 49 of the needle thread 38 also called upper thread, which still hang down from the workpiece 36 after sewing and thread-cutting, and of the lower thread 43 also called hook thread. The trimming device 47 is located in the x-direction behind the stitch forming place 46, i.e.—seen from the operator's side 50—it is on the right of the stitch forming place 46. Further, it is located within the reach of the workpiece holder 10, i.e. each point of the workpiece 36 held in the workpiece holder 10 can also be brought over this trimming device 47.

The trimming device 47 has a tube-shaped suction sleeve 51 passing through an adjusted boring 52 in the bearing plate 45. It further has a flange 53 screwed to the lower side of the bearing plate 45 by means of sunk screws 54.

A solution hose 55 is applied to the lower end of the solution sleeve 51 turned away from the bearing plate 45. The suction sleeve 55 can be connected to a vaccum source, i.e. a partial vaccum can act on it. Adjacent to the bearing plate 45 a nozzle 56 is inserted in the suction sleeve 51; the narrowest cross-section 57 of the nozzle 56 having a diameter d, which is clearly smaller than the diameter D at the nozzle outlet 58. The nozzle 56 equally tapers in the direction of the nozzle inlet. This usual consturction of the nozzle 56 assures that the air current sucked through it from the nozzle inlet 59 to the nozzle outlet 58 is considerably accelerated in the nozzle 56. As a result the thread ends 48, 49 hanging down from the workpiece 36 are sucked into the nozzle 56 when guided over the nozzle inlet 59. Directly below the nozzle inlet 59 are thread trimming means 60 formed by a heating wire 61, to which a heating current is fed via an electric cable 62.

When the thread ends 48, 49 are guided over the thread trimming device 47, they are sucked into it. Any minor movement of the workpiece 36 into x-direction guides them over the heating wire 61 running in the y-direction and thus they are melted. The severed thread ends are sucked off. The remaining thread ends 64, 65 immediately on the lower side are melted with one another, i.e. they can no longer untwist. So as to prevent the heating wire 61 from damaging the workpiece itself, the heating wire 61 is arranged some tenths of a millimeter below the nozzle inlet 59, i.e. some tenths of a millimeter below the upper side 66 of the bearing plate 45.

Sewing of the seam 37 in the workpiece 36 is done inusual manner program-controlled, i.e. by displacing the workpiece holder 10 in the x- and y-direction, with the control of the drive motors 17 and 25 being effected by the control unit 35 corresponding to the program fed in by the program carrier P.

After the sewing action has been terminated, i.e. after the thread cutting action at the stitch forming place 46, the workpiece holder 10 with the workpiece 36 is changed in position so that first the seam starting point 67 and then the seam end point 68 are guided one after the other over the thread trimming device 47, with a minor displacement of the workpiece holder 10 in the x-direction taking place during each thread trimming procedure, as above indicated.

Compared to the stitch forming place 46 the thread trimming device 47 is staggered by the distance a in the x-direction and by the distance b in the y-direction. These are invariable distances, which may also be definitely programmed in the control unit 35. In order to bring the seam starting point 67 and the seam end point 68, respectively, over the thread trimming means 60, only machine-related data given through the distance a and b must be added to the freely programmed data determining these points. So as to give an even clearer idea of the displacement of the workpiece holder for the purpose of the thread trimming procedures, a corner 69—bottom of FIG. 1 on the right—of the workpiece holder 10 is shown as reference point 69', while the seam starting point 67 is positioned over the trimming means 60. It is further shown as reference point 69'', while the seam end point 68 is positioned over the trimming means.

As can be seen from FIG. 1, the workpiece holder has a rectangular aperture 70, in the fringe area of which the workpiece 36 is clamped and thus held. A seam 37 may be sewn within this aperture 70. For simplification this aperture 70 is therefore called the operating range 71. This operating range 71 extends for a distance c in the x direction and a distance e in y-direction. The maximum sliding path of the x-carriage 12 in the x-direction is x-max. The maximum sliding path of the y-carriage 11 in the y-direction is y-max., so that in each case the following relation applies:

$$x\text{-max.} \geqq a + c$$

$$y\text{-max.} \geqq b + e$$

The sliding paths shown in FIG. 1 do not correctly correspond to the maximum sliding paths x-max. and y-max., since the x-carriage 12 and the y-carriage 11 are not in each case at the beginning of their maximum sliding path. Since the maximum sliding paths x-max. and y-max. affect the size of the machine and the overall constructive featuring of this machine, a and b must in each case be chosen as small as posible.

Figure 5:
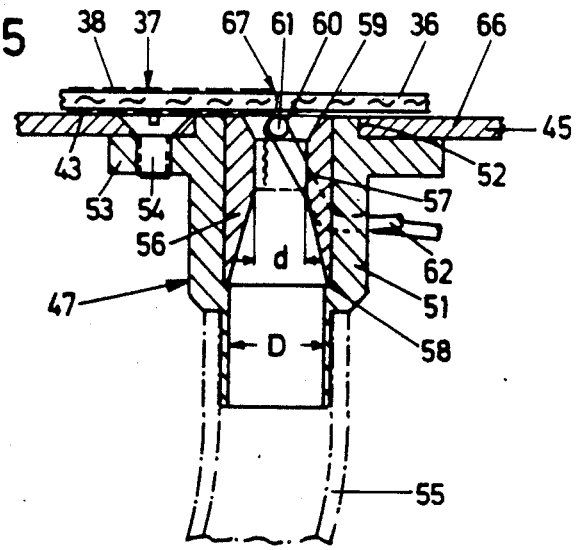
FIG. 5 is a vertical section through a trimming device.
Figure 6:
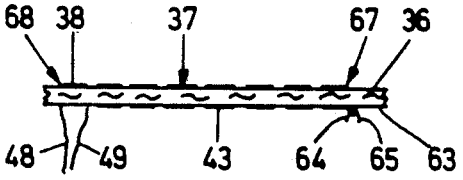
FIG. 6 shows a workpiece to be trimmed in the trimming device.

FIG. 5 shows how the thread ends of the seam starting point 67 are trimmed in the thread trimming device, whereas FIG. 6 shows a workpiece which has already been trimmed at the seam starting point 67, but which must still be trimmed at the seam end point 68. It may be added that also at the beginning of the seam the thread end of the needle thread 38 and the lower thread 43 may hang down, if for example a device is used according to U.S. Pat. No. 4,658,752.

If a seam 37 to be produced in the workpiece 36 has several seam sections each with a seam starting point and a seam end point, the free thread ends can be trimmed one after another in the thread trimming device 47 through corresponding programming of the control unit 35.

What is claimed is:

1. A computerized numerical control automatic sewing device comprising a sewing head having a stitch forming place with a thread cut-off device and a workpiece holder for holding a workpiece to be sewn, the sewing head and the workpiece holder being movable relative to one another in two co-ordinate directions by means of two carriages displaceable perpendicularly to one another each along a sliding path to produce a seam within an operating range of the workpiece holder, a thread device is spaced a predetermined distance from the stitch forming place, said trimming device is stationary relative to the forming place and directly below the workpiece holder, and a maximum sliding path of the workpiece holder in each co-ordinate direction is in each case at equal to the dimensions of the operating range in the corresponding co-ordinate direction plus the distance of the trimming device from the stitch forming place in the corresponding co-ordinate direction.

2. An automatic sewing device according to claim 1, wherein a bearing plate (45) supporting the workpiece holder (10) is provided, to which the trimming device (47) is attached.

3. An automatic sewing device according to claim 1, wherein the trimming device (47) has a suction nozzle (56), the nozzle inlet (59) of which is positioned directly below the workpiece holder (10).

4. An automatic sewing device according to claim 1, wherein the trimming device (47) is provided with thread trimming means (60) positioned directly below the workpiece holder (10).

5. An automatic sewing device according to claim 4, wherein the thread trimming means (60) consist of at least one heating wire (61).

* * * * *